US007537511B2

(12) United States Patent
Kistler

(10) Patent No.: US 7,537,511 B2
(45) Date of Patent: May 26, 2009

(54) EMBEDDED FIBER ACOUSTIC SENSOR FOR CMP PROCESS ENDPOINT

(75) Inventor: Rodney C. Kistler, Eagle, ID (US)

(73) Assignee: Micron Technology, Inc., Boise, ID (US)

( * ) Notice: Subject to any disclaimer, the term of this patent is extended or adjusted under 35 U.S.C. 154(b) by 58 days.

(21) Appl. No.: 11/374,867

(22) Filed: Mar. 14, 2006

(65) Prior Publication Data

US 2007/0218806 A1 Sep. 20, 2007

(51) Int. Cl.
*B24B 49/00* (2006.01)

(52) U.S. Cl. ..... 451/5; 451/6; 451/10; 451/11; 451/41; 451/526

(58) Field of Classification Search ..... 451/5, 451/6, 8, 10, 11, 41, 285, 287, 526, 533
See application file for complete search history.

(56) References Cited

U.S. PATENT DOCUMENTS

| | | | | |
|---|---|---|---|---|
| 5,039,190 | A | 8/1991 | Blonder et al. | |
| 5,222,329 | A | 6/1993 | Yu | |
| 5,240,552 | A | 8/1993 | Yu et al. | |
| 5,245,794 | A | 9/1993 | Salugsugan | |
| 5,433,651 | A | 7/1995 | Lustig et al. | |
| 5,439,551 | A | 8/1995 | Meikle et al. | |
| 5,621,290 | A | 4/1997 | Heller et al. | |
| 6,361,646 | B1 * | 3/2002 | Bibby et al. | 156/345.1 |
| 6,364,746 | B2 | 4/2002 | Moore | |
| 6,377,009 | B1 | 4/2002 | Philipp | |
| 6,540,587 | B1 | 4/2003 | Gotkis et al. | |
| 6,579,157 | B1 | 6/2003 | Gotkis et al. | |
| 6,676,482 | B2 * | 1/2004 | Bibby et al. | 451/6 |
| 6,739,945 | B2 * | 5/2004 | Halley et al. | 451/6 |
| 6,752,693 | B1 | 6/2004 | Kistler | |
| 6,769,961 | B1 | 8/2004 | Kistler et al. | |
| 6,808,590 | B1 | 10/2004 | Gotkis et al. | |
| 6,827,630 | B2 | 12/2004 | Moore | |
| 6,859,765 | B2 | 2/2005 | Gotkis et al. | |
| 6,872,132 | B2 | 3/2005 | Elledge et al. | |
| 6,875,322 | B1 | 4/2005 | Kistler | |
| 6,890,245 | B1 | 5/2005 | Kistler | |

(Continued)

FOREIGN PATENT DOCUMENTS

GB 2243217 A1 10/1991

OTHER PUBLICATIONS

Lee, D.L., et al., Laboratory for Manufacturing Automation. Precision Manufacturing Group, Jul. 2005. http://repositories.cdlib.org/lma/pmg/lee_05_1.

(Continued)

*Primary Examiner*—Eileen P. Morgan
(74) *Attorney, Agent, or Firm*—Whyte Hirschboeck Dudek SC

(57) ABSTRACT

Devices, systems and methods for monitoring characteristics of semiconductor substrates and workpieces during planarization and for endpointing planarization processes are provided. The invention utilizes a fiber optic contact sensor incorporated into a planarizing pad or pad-subpad assembly for process monitoring of mechanical energy (e.g., mechanical vibration) and acoustical energy (e.g., ultrasonic vibration) that allows an operator to determine status and/or an endpoint of a planarizing or polishing process. In another embodiment, the invention utilizes a fiber optic contact sensor incorporated into a table support for a planarizing pad.

23 Claims, 9 Drawing Sheets

U.S. PATENT DOCUMENTS

| | | | | |
|---|---|---|---|---|
| 6,894,491 | B2 | 5/2005 | Gotkis et al. | |
| 6,896,596 | B2 | 5/2005 | Gotkis et al. | |
| 6,910,942 | B1 | 6/2005 | Dornfeld et al. | |
| 6,918,301 | B2 | 7/2005 | Elledge | |
| 6,922,053 | B2 | 7/2005 | Gotkis et al. | |
| 6,925,348 | B2 | 8/2005 | Kistler et al. | |
| 6,929,531 | B2 | 8/2005 | Gotkis et al. | |
| 6,932,672 | B2 | 8/2005 | Elledge | |
| 6,935,929 | B2 | 8/2005 | Elledge | |
| 6,937,915 | B1 | 8/2005 | Kistler et al. | |
| 6,951,624 | B2 | 10/2005 | Gotkis et al. | |
| 6,984,892 | B2 | 1/2006 | Gotkis et al. | |
| 6,986,701 | B2 | 1/2006 | Halley et al. | |
| 7,010,468 | B2 | 3/2006 | Gotkis et al. | |
| 7,052,365 | B2 | 5/2006 | Dornfeld et al. | |
| 7,070,478 | B2 | 7/2006 | Elledge et al. | |
| 7,084,621 | B2 | 8/2006 | Gotkis et al. | |
| 7,128,803 | B2 | 10/2006 | Owczarz et al. | |
| 7,131,891 | B2 | 11/2006 | Elledge | |
| 7,169,016 | B2 * | 1/2007 | Barada et al. | 451/6 |
| 7,182,669 | B2 | 2/2007 | Elledge | |
| 7,201,632 | B2 | 4/2007 | Elledge | |
| 7,205,166 | B2 | 4/2007 | Gotkis et al. | |
| 7,229,338 | B2 | 6/2007 | Agarwal | |
| 7,255,630 | B2 | 8/2007 | Elledge | |
| 7,284,769 | B2 | 10/2007 | Breed | |
| 2002/0191197 | A1 * | 12/2002 | Bibby et al. | 356/630 |
| 2003/0085679 | A1 | 5/2003 | Bledin et al. | |
| 2005/0223805 | A1 | 10/2005 | Ganesan et al. | |

OTHER PUBLICATIONS

DAS, Tapas K. et al., IEEE Transactions on Semiconductor Manufacturing, pp. 1-11, vol. X, No. X, 2004.

Abacus Optical Mechanics Inc., Contact Fiber Optic Sensor for detection of: Intrusion, Dec. 2005, www.abacusa.com/aom/br-12inc.pdf#search='optical%20fiber%acoustic%20emission%emission%-20sensor'.

Abacus Optical Mechanics, Fiber Optic Sensors, Nov. 28, 2005, http://www.abacusa.com/aom/.

Abacus Optical Mechanics, Capacitor Sensors, Dec. 16, 2005; http://www.abacusa.com/aom/cap-sen.html.

Inscap & Abacus Optical Mechanics, Capacitor Proximity Sensor, Dec. 16, 2005, http://abacusa.com/inscap/cps.

PadProbe for Monitoring an Control of Pad Surface, Dec. 8, 2005, http://www.cetr.com/PadProbe_for_Monitoring_Control_Pad%20Surface.htm.

* cited by examiner

EMBEDDED FIBER ACOUSTIC SENSOR FOR CMP PROCESS ENDPOINT

FIELD OF THE INVENTION

The invention relates generally to apparatus and methods for endpointing mechanical and/or chemical-mechanical planarization of semiconductor wafers and other microelectronic substrates.

BACKGROUND OF THE INVENTION

Fabricating integrated circuit devices involves forming multiple layers of conducting, semiconducting, dielectric, and insulting materials on a substrate. During fabrication, the substrate is typically planarized at various stages to make it level and uniform, and eliminate recesses, protrusions, scratches, and other undesirable topology, which can cause step coverage problems for the deposition of a subsequent material layer and depth of focus problems that impair photolithographic processes used to form sub-micron features.

Chemical-mechanical polishing and chemical-mechanical planarization processes, both of which are referred to herein as "CMP" processes, are abrasive techniques that typically include the use of a combination of chemical and mechanical agents to planarize, or otherwise remove material from a surface of a micro-device workpiece (e.g., wafers or other substrate) in the fabrication of micro-electronic devices and other products. A planarizing or polishing pad ("planarizing pad") is used with a chemical solution along with abrasives, which may be present in the solution as a slurry or fixed within the pad itself, to mechanically remove material from the workpiece surface.

FIG. 1 illustrates a conventional chemical-mechanical planarization apparatus 10 with a circular table or platen 12, a carrier assembly 14, and a planarizing pad 16. An underpad or subpad 17 can be attached to the planarizing pad 16 or to a surface of the platen 12 for supporting the planarizing pad 16. A drive-assembly 18 rotates the platen 12 (indicated by arrow "A") and/or reciprocates the platen 12 back and forth (indicated by arrow "B"), and the motion provides continuous movement of the planarizing pad 16 relative to a workpiece 20 (e.g., a wafer) secured onto a substrate holder 22. In the illustrated embodiment, an actuator assembly 24 is coupled to the substrate holder 22 to provide axial and/or rotational motion to the substrate holder 22 as indicated, respectively, by arrows "C" and "D". Also as shown, the substrate holder 22 is coupled by an arm 28 to a sweep actuator 26 that rotates (indicated by arrow "E") to "sweep" the substrate holder 22 along a path across the planarizing surface 30 of the planarizing pad 16. In operation, the workpiece 20 and/or the planarizing pad 16 are moved relative to one another allowing abrasive particles in the pad or slurry to mechanically remove material from the surface of the workpiece 20, and reactive chemicals of the planarizing solution 32 on the surface 30 of the planarizing pad 16 to chemically remove the material.

The apparatus 10, shown in FIG. 1, also includes a second carrier assembly 34 having a carrier 36 for a conditioning pad 38 that is brought into contact against the planarizing surface 30 of the planarizing pad 16. The conditioning pad 38 abrades the surface 30 of the planarizing pad to abrade it, which prevents glazing of the pad surface and provides a fresh surface for polishing.

In the process of chemical-mechanical polishing, the incoming substrates have certain topography as a result of the features that are fabricated on them, and the overlying films deposited over the features. In a production flow, it is desirable to maximize throughput, which for CMP processing is to remove a material layer and/or produce a planar surface on a substrate as quickly as possible. Many CMP processes require a process endpoint based upon removal of topography, degree of planarization of the workpiece surface, and/or the transition from one material layer to a next material layer, for example, from an oxide layer to a nitride layer. It is important to accurately stop CMP processing at a desired endpoint so that the workpiece substrate is not under-planarized, requiring re-polishing, or over-planarized, which can cause "dishing" or completely destroy components on the substrate. In a typical CMP process, the desired endpoint is reached when the surface of the substrate is planar and/or enough material has been removed from the substrate to expose a desired underlayer or to form the desired components, for example, a shallow trench isolation area, a contact, etc.

There are various conventional methods for determining the endpoint of a CMP process. One method involves using an estimated polishing rate based upon the polishing rate of identical substrates planarized under the same conditions to determine the planarizing period of the particular substrate at hand. This method may not produce accurate results due to differences in polishing rates and variations from one substrate to another.

In another method for determining the endpoint of a CMP processing, the workpiece is removed from the pad and a change in thickness of the substrate is measured. However, interrupting a CMP process to remove the workpiece from the pad reduces CMP processing throughput and can cause damage to the workpiece.

There are also apparatus for monitoring planarizing during a process cycle. Some apparatus incorporate a sensor for measuring reflectance of the surface of a wafer to infer that a process point has been reached, for example, according to film thickness or the transition from an opaque to a transparent surface.

Other methods of endpointing a CMP process include the use of acoustic emission sensing in a wafer carrier. However, incorporating sensors into the carrier poses problems with signal dampening. Such a set-up is also not practical in manufacturing applications due to the need to isolate the carrier from the carrier using a urethane containing material, which leads to high signal attenuation.

Therefore, it would be desirable to develop an apparatus and method for more accurately monitoring and endpointing planarization and polishing of microelectronic substrates.

SUMMARY OF THE INVENTION

The present invention is directed toward systems and methods for monitoring characteristics of a micro-device workpiece surface during planarization and for endpointing a CMP process, and methods for planarizing a micro-device workpiece and endpointing mechanical and/or chemical-mechanical planarization of microelectronic substrates.

The invention utilizes a fiber optic contact sensor for CMP process monitoring of mechanical energy (e.g., mechanical vibration) and acoustical energy (e.g., ultrasonic vibration) that allows an operator to determine status and/or an endpoint of a planarizing or polishing process.

In one aspect, the invention provides a planarizing pad or pad-subpad assembly with an associated fiber optic impact sensor. The sensor is configured to convey a light source to a receiver, the intensity of the light source altered by vibrational or acoustic emissions emanating from the frictional contact of the planarizing pad with the surface of a wafer or other workpiece. In one embodiment, the planarizing pad comprises a fiber optic impact sensor embedded within the body of the pad. In another embodiment, the fiber optic impact sensor is situated between a planarizing pad and subpad. In a further embodiment, a fiber optic impact sensor is embedded within the body of a subpad for a planarizing pad. In preferred embodiments, the sensor comprises a cable arranged within the pad, subpad, or pad-subpad assembly, to define a wafer track, and is preferably continuous about the track.

In another aspect, the invention provides a support for a planarizing pad in a planarizing apparatus, which incorporates a fiber optic impact sensor. In one embodiment, the fiber optic impact sensor is situated within a depression or opening (e.g., channel, etc.) provided in the surface of the table on which planarizing pad is received. In another embodiment of the table, the sensor is embedded within the body of the table at or near the surface of the table.

Another aspect of the invention provides an apparatus for monitoring and/or endpointing a planarizing process composed of a planarizing apparatus that includes one of the foregoing planarizing pads, pad-subpad assemblies, or support tables for a planarizing pad, with an associated fiber optic impact sensor. In one embodiment, the apparatus includes a carrier for the substrate, a planarizing pad or pad-subpad assembly situated on a support with a fiber optic impact sensor incorporated into the pad, pad-subpad assembly or support, and an assembly movably coupled to and operable to move the support.

A further aspect of the invention provides systems for monitoring a substrate while being planarized. In one embodiment, the system comprises a planarizing apparatus that includes a platen supporting a planarizing pad or pad/subpad assembly that incorporates a fiber optic impact sensor, a signal control device connected to the sensor and operable to transmit and receive light signals through the sensor and produce an electrical signal relating to the received light signal, and a processor (e.g., computer) operable to receive and process signals from the signal control device to determine physical properties of the substrate and relay signals to the planarizing apparatus to adjust the planarizing based on the determined physical properties of the substrate. The system can be configured to determine real-time properties of the substrate based on the signals from the sensor.

In operation, CMP processing is monitored and an endpoint can be detected according to changes in light intensity readings due to changes on the sensor from vibration or acoustic emissions from the workpiece surface as a planarization progresses. By analyzing the vibration or acoustic emissions, the state of the wafer surface and an endpoint of the CMP operation can be determined and monitored in real time. Such emissions can be correlated, for example, to changes in surface topography, changes in composition of the contacted material layers, or other parameter for a particular CMP application. Process parameters of the CMP process can then be adjusted as needed.

In another aspect, the invention provides methods for monitoring a substrate while planarizing the substrate and/or determining an endpoint of a CMP operation. In one embodiment, the method includes planarizing the substrate by contact with a planarizing pad or pad-subpad assembly that incorporates a fiber optic impact sensor, and processing the signals from the sensor to determine physical properties of the substrate. In another embodiment, the method comprises planarizing the substrate with a planarizing pad situated on a support table with an incorporated fiber optic sensor, and processing the signals from the sensor to determine and assess characteristics of the substrate. In an embodiment of a method for determining an endpoint of a planarizing process, the method comprises planarizing a surface of a substrate by contact with a planarizing pad-subpad assembly comprising a fiber optic impact sensor embedded within the pad or the subpad, or interposed between the pad and subpad, processing the signals from the sensor to generate data of a characteristic of the surface of the substrate, analyzing the data to determine whether the endpoint has been reached, and controlling the planarizing process in response to the analysis of the data.

In another aspect, the invention provides a planarizing pad conditioning apparatus. In one embodiment, the conditioning apparatus is composed of a support table for a planarizing pad, and a carrier for a conditioning pad, the carrier having a fiber optic impact sensor attached thereto. In another embodiment, a conditioning apparatus configured to monitor a planarizing pad while conditioning the pad includes a fiber optic impact sensor attached to a carrier for a conditioning pad, an assembly movably coupled to and operable to move the carrier, and a support for a planarizing pad.

In yet another aspect, the invention provides a system configured for monitoring a planarizing pad while being conditioned. In one embodiment, the system is composed of a conditioning apparatus comprising a conditioning pad carrier having a fiber optic impact sensor attached thereto, a signal control device operable to transmit and receive signals through the sensor and produce an electrical signal relating to the received signal, and a processor operable to receive and process electronic signals from the signal control device to determine physical properties of the planarizing pad, and relay signals to the conditioning apparatus to adjust the conditioning process based on the determined physical properties of the planarizing pad. In another embodiment the system comprises a conditioning apparatus comprising a conditioning pad carrier having a fiber optic impact sensor attached thereto, a signal control device operable to receive signals from the sensor, and a processor operable to receive and process the signals from the signal control device to determine physical properties of the planarizing pad and vary the conditioning operation based on the determined characteristics of the planarizing pad.

In a further aspect, a method of monitoring the conditioning of a planarizing pad is provided. In one embodiment, the method includes conditioning an abrading surface of the planarizing pad by contact with a conditioning pad, the conditioning pad supported by a carrier having a fiber optic impact sensor attached thereto, and processing the signals from the sensor to determine physical properties of the planarizing pad. In another embodiment, the monitoring method includes conditioning an abrading surface of the planarizing pad by contact with a conditioning pad, the conditioning pad supported by a carrier having a fiber optic impact sensor attached thereto, processing the signals from the sensor to generate data of a characteristic of the surface of the abrading surface of the pad, analyzing the data to evaluate the abrading surface of the pad, and controlling the conditioning process in response to the analysis of the data.

Many CMP processes require a process endpoint based upon topography removal or degree of planarization, and transition from one film to the next, e.g., oxide to nitride. By incorporation of a fiber optic sensor into the CMP pad or CMP-subpad assembly or the CMP support table, increased sensitivity is gained to monitor acoustic energy or vibration signatures emanating from the wafer:pad interface during CMP processing. The present invention provides a non-obtrusive approach that can be readily incorporated into a CMP pad with sufficient density such that high spatial mapping of the substrate acoustic energy or vibration spectrum can be obtained with a high level of precision that is representative of the degree of planarization or process endpoint. The incorporation of an acoustic or vibrational sensor directly into a CMP pad or pad-subpad assembly provides improved spatial sensing to enable monitoring of wafer clearing as a function of discrete radii sections across the wafer. The invention advantageously reduces quality losses, and significantly increases productivity, throughput and yield.

BRIEF DESCRIPTION OF THE DRAWINGS

Preferred embodiments of the invention are described below with reference to the following accompanying drawings, which are for illustrative purposes only. Throughout the following views, the reference numerals will be used in the drawings, and the same reference numerals will be used throughout the several views and in the description to indicate same or like parts.

FIG. 6 shows the sensor situated within a channel formed into the surface of the table along the wafer path. FIG. 6A shows a partial view of a support table with the sensor embedded into the body of the table at the surface.

DETAILED DESCRIPTION OF THE INVENTION

The following description with reference to the drawings provides illustrative examples of devices, assemblies, systems, and methods for monitoring and/or endpointing planarizing and conditioning processes in mechanical or chemical-mechanical planarization of semiconductor wafers and other microelectronic substrates according to the invention. Such description is for illustrative purposes only and not for purposes of limiting the same. The present invention can be utilized to provide other embodiments of devices, assemblies, and systems in accordance with the invention.

In the context of the current application, the term "semiconductor substrate" or "semiconductive substrate" or "semiconductive wafer fragment" or "wafer fragment" or "wafer" will be understood to mean any construction comprising semiconductor material, including but not limited to bulk semiconductive materials such as a semiconductor wafer (either alone or in assemblies comprising other materials thereon), and semiconductive material layers (either alone or in assemblies comprising other materials). The term "substrate" refers to any supporting structure including, but not limited to, the semiconductive substrates, wafer fragments or wafers described above. The terms "micro-device workpiece" and "workpiece" are understood to include a variety of substrates in or on which micro-electronic devices, micromechanical devices, data storage elements, and other features are fabricated. For example, workpieces can be semiconductor wafers, glass substrates, dielectric or insulated substrates, and metal-containing substrates, among others. The terms "planarization" and "planarizing" refer to the removal of material from a surface by chemical-mechanical or mechanical planarization or polishing. The terms "chemical-mechanical polishing" and "CMP" refer to a dual mechanism having both chemical and mechanical components to remove material, as in wafer polishing.

The planarizing pads of any of the embodiments of the invention can be fabricated using a conventional pad material, for example, a thermoplastic polyurethane, polyvinyl, nylon, polymethylmethacrylate, polytetrafluoroethylene, natural and synthetic resins, among others, and can be filled or unfilled. The planarizing pad can be produced by conventional processes, for example, but not limited to, casting, molding (injection molding, blow molding, etc.), sintering, and extrusion. The planarizing pad can be fabricated without abrasive particles embedded therein, to be used with a slurry planarization composition that includes abrasive particles. The planarizing pad can also be in the form of an abrasive polishing pad ("fixed-abrasive pad") that is fabricated with abrasive particles fixed in the pad material, to be used with a planarization composition without abrasive particles therein.

Figure 2:
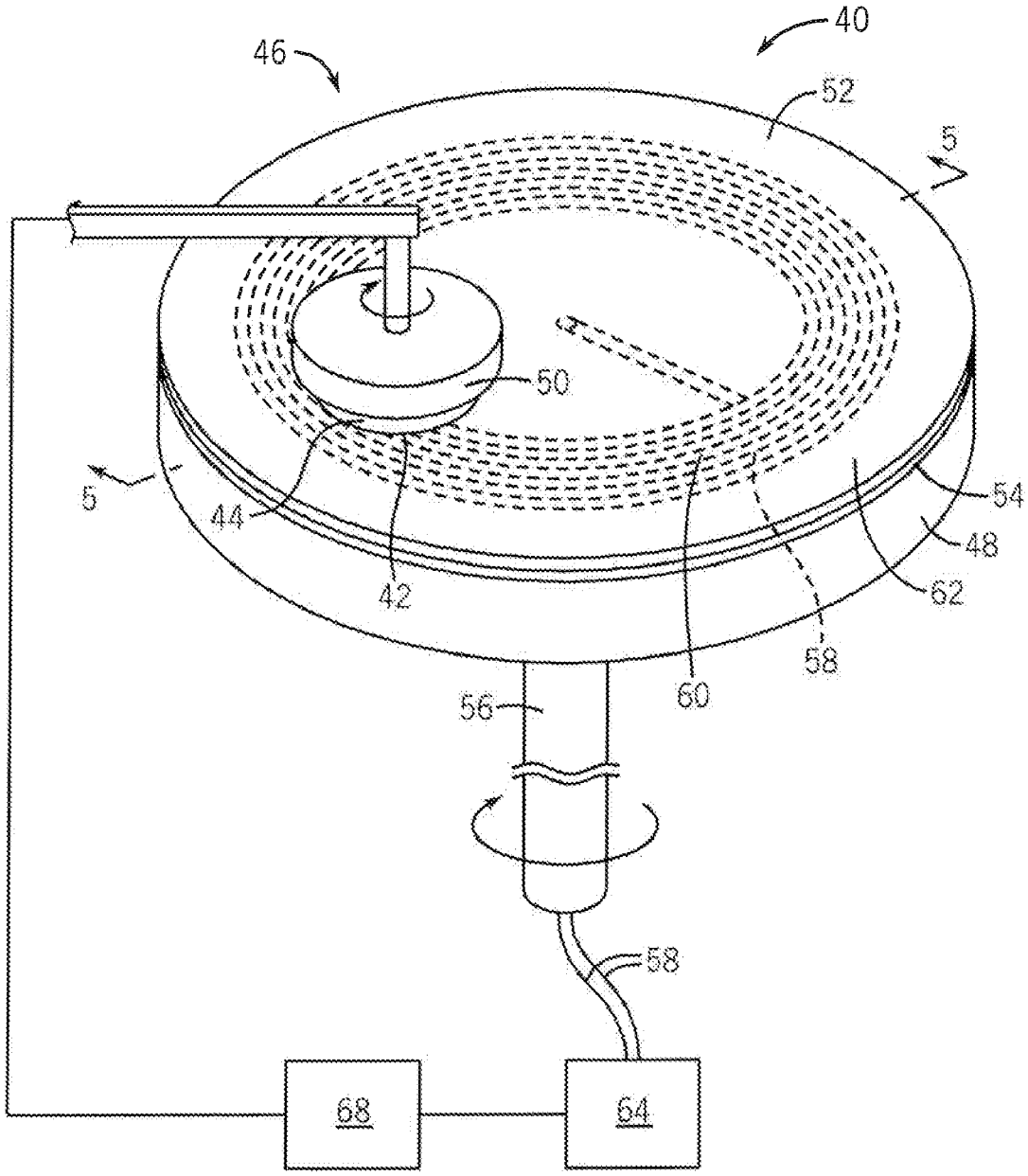
FIG. 2 is an isometric view of an embodiment of a system according to the invention for planarizing a workpiece.
Figure 3:
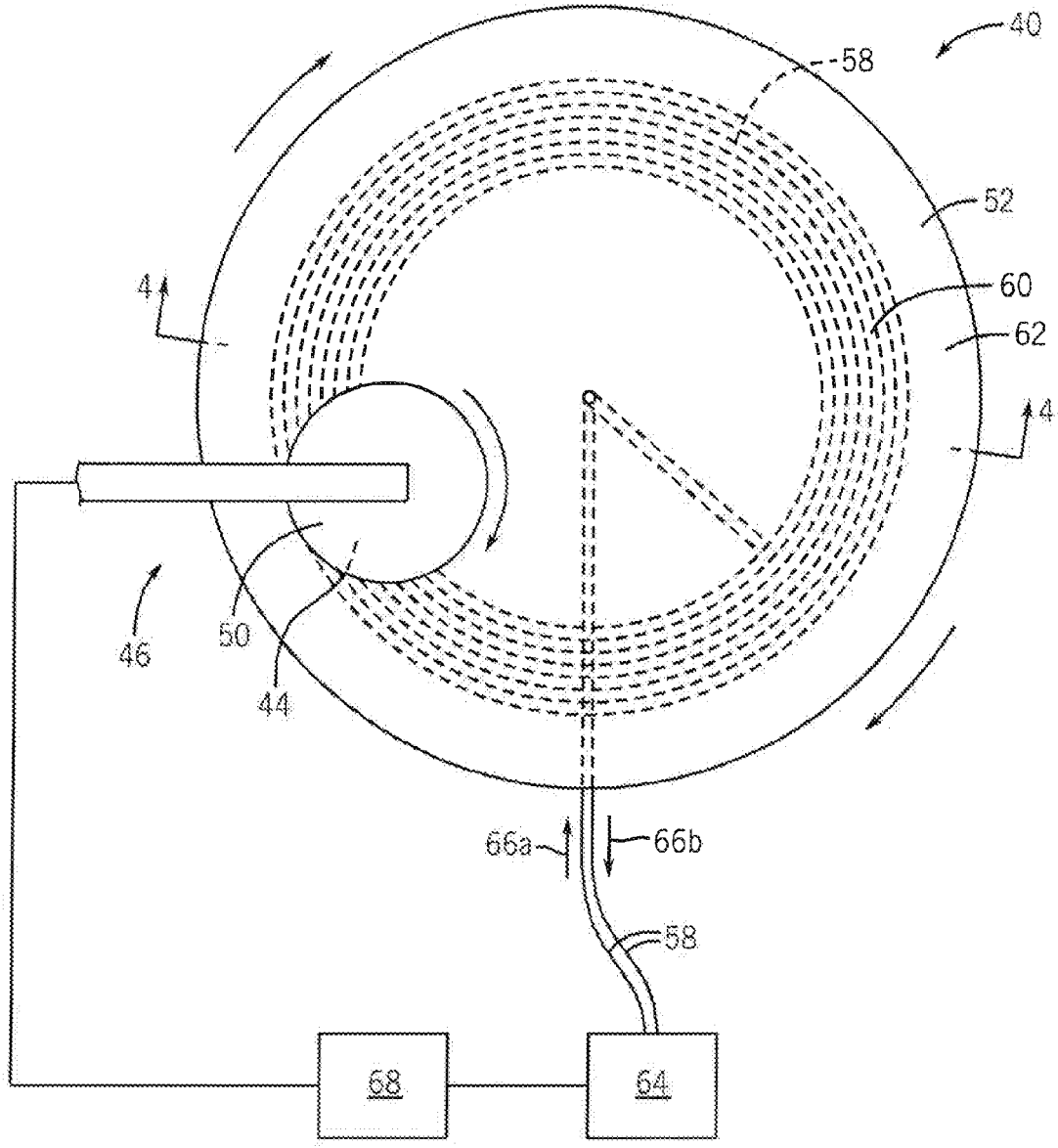
FIG. 3 is a top view of the system of FIG. 2.

FIG. 2 is a schematic view and FIG. 3 is a top view of a system 40 for monitoring the characteristics of the surface 42 of a workpiece 44, shown as a wafer, according to an embodiment of the invention.

Figure 1:
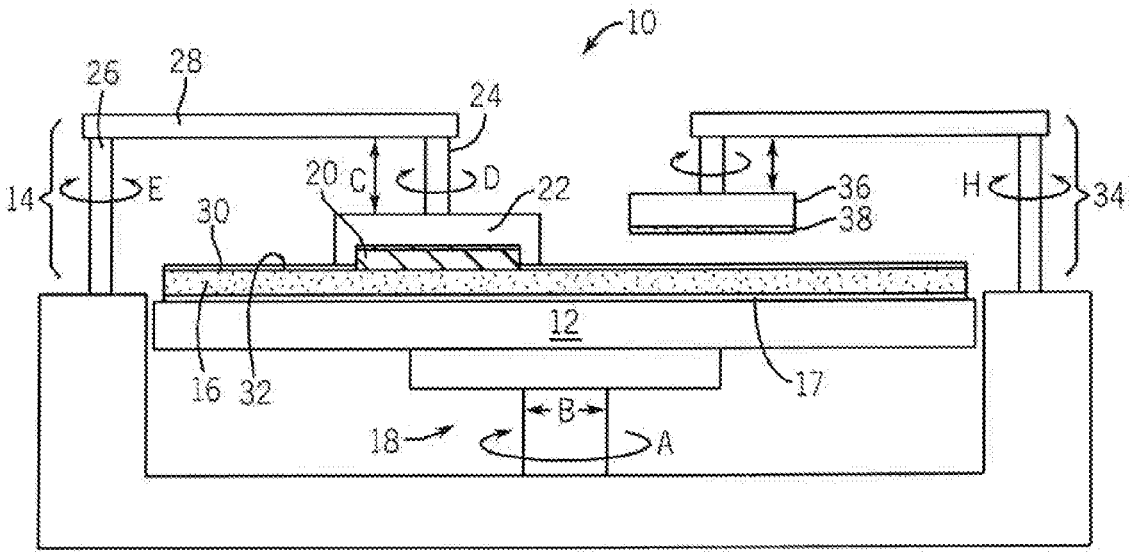
FIG. 1 PRIOR ART
FIG. 1 is a schematic, cross-sectional view of an embodiment of a prior art planarizing apparatus.

The system 40 can be used with a planarizing apparatus 46 similar to the planarizing apparatus 10 discussed above with reference to FIG. 1. As illustrated in FIG. 2, the planarizing apparatus 46 includes a circular table or platen 48, a carrier 50 supporting a wafer 44, a planarizing pad 52, a compressible subpad 54, and a drive-assembly 56 that moves the platen 48. The subpad 54 can be adhesively attached to the planarizing pad 52 or to the platen 48 supporting the planarizing pad.

According to the invention, the system 40 incorporates a contact fiber optic impact sensor 58, shown in phantom in FIG. 2, for monitoring the status of a characteristic of the wafer 52 during a planarizing process. The impact sensor 58 can be arrayed to achieve maximum amount of coverage of wafer movement across the pad. The wafer is typically moved by the planarizing apparatus along a characteristic track or path 60 over the surface of the planarizing pad and, in a preferred embodiment, the sensor 58 is situated to define a wafer track 60, shown as a circular or oval path in FIG. 2.

Figure 3A:
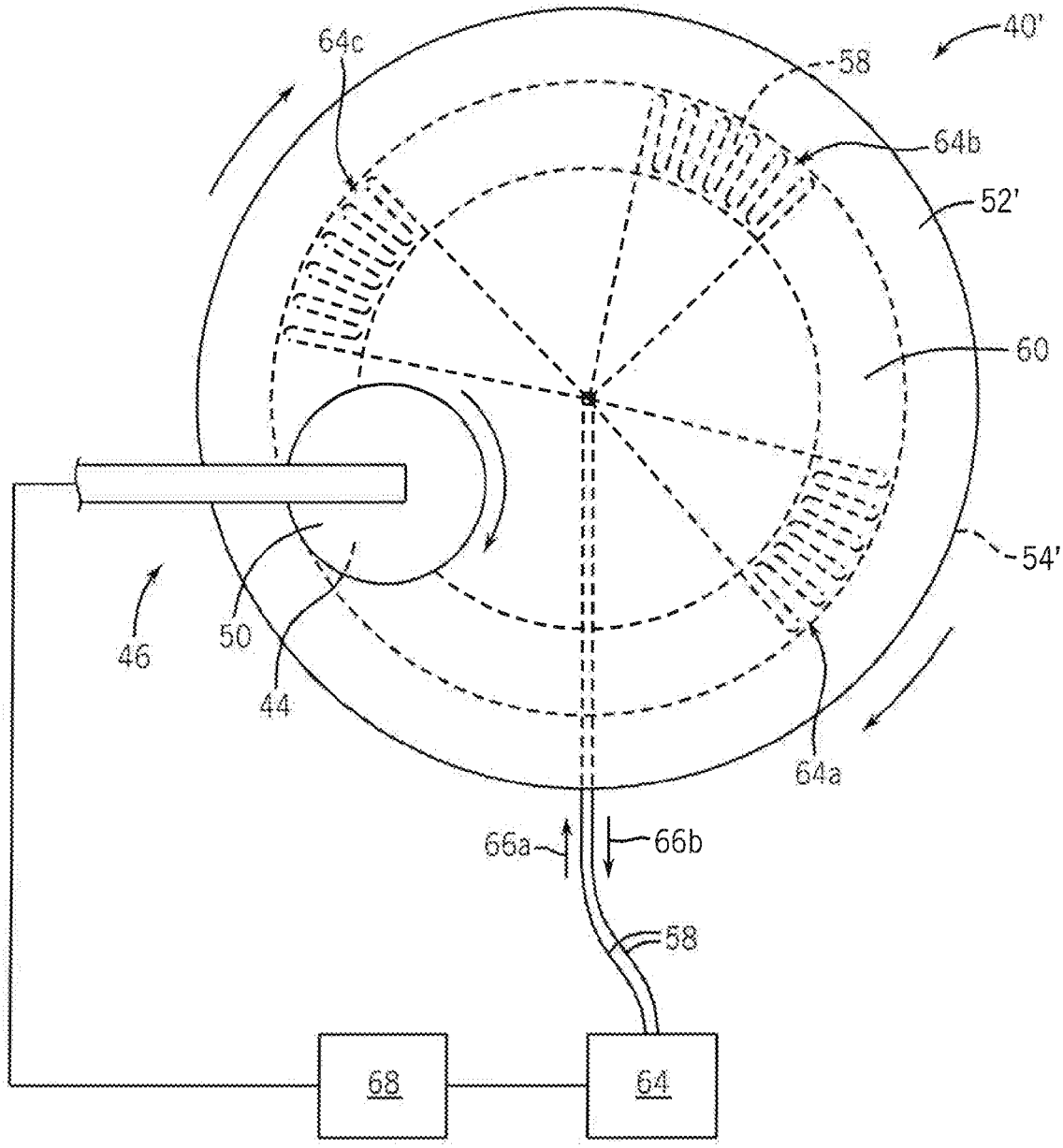
FIG. 3A is a top view of another embodiment of the system of FIG. 2, in which the sensor is situated at discrete locations within the wafer track.

The fiber optic impact sensor 58 is preferably provided as a flexible cable containing one or more optical fibers, with impact sensing capability along its length. Preferably, the sensor cable 58 is arrayed to achieve maximum amount of coverage of the wafer 44 as it is moved across the pad surface 62. The sensor cable 58 can be advantageously coiled or otherwise adjacently arranged in a side-by-side layout that corresponds to the wafer track 60, which layout can be oriented according to a particular application. The number of sensor cables positioned on or within the pad 52, subpad 54, and/or table 48, preferably covers the width of the wafer track 60, which is typically about 200-300 mm wide. In a preferred embodiment, the sensor cable 58 is continuous about the wafer track 60, as depicted in FIGS. 2-3. In another embodiment, as shown in FIG. 3A, the sensor cable 58 can be positioned on or within the pad 52, subpad 54, and/or table 48 in one or more discrete sections 64*a-c* of the wafer track 60, to capture a sample of the vibrational or acoustic energy emitted from the wafer 44 surface according to the frequency of rotation of the pad 52 relative to the wafer 44.

The system 40 includes a control box 64 with optoelectronics including a light source, photodetector, and associated signal processing electronics, which is connected to a loop of sensor cable 58 containing the fiber optic impact sensor. Light is transmitted into one end of the sensor (arrow 66*a*), for example, by an LED (light-emitting diode) or laser, and returned via the other end (arrow 66*b*) to the photodetector within the control box, which produces an electrical signal in relation to the intensity of the light falling on it. The system 40 monitors changes in intensity of a set wavelength of light passing through the sensor coil 58, which will vary according to energy that is applied or conveyed to the sensor, including vibration and acoustic emissions. The electrical signal can be transmitted to a microprocessor 68 for processing to monitor the progress of a polishing operation or determining whether the end-point of the planarizing process has been reached, and relaying signals to the planarizing apparatus 46. The control box 64 can include controls to adjust the sensitivity of the sensor 58 as needed.

Conventional planarizing pads are round or disk-shaped, planar, and have larger dimensions than the wafer or other workpiece to be planarized or polished. Planarizing pads are typically fabricated by forming the pad material into large cakes that are subsequently skived, or sliced, to a desired thickness, or by individually molding the pad.

Figure 4A:
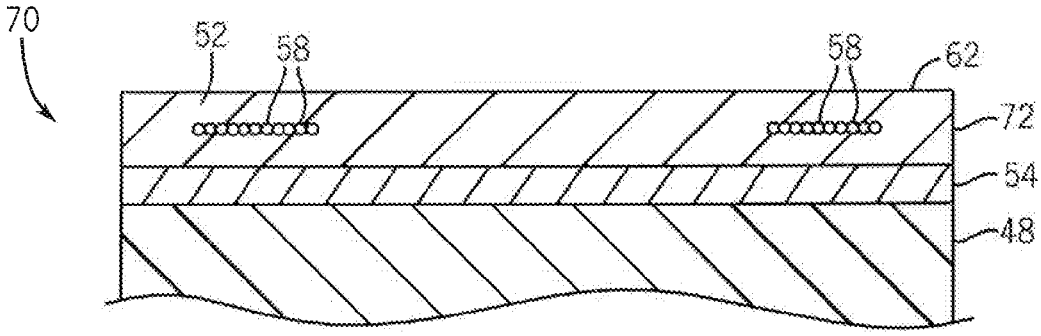
FIGS. 4A-4C are diagrammatic, cross-sectional, elevational views of embodiments of a planarizing pad of the apparatus shown in FIGS. 2-3 taken along line 4-4.
Figure 5:
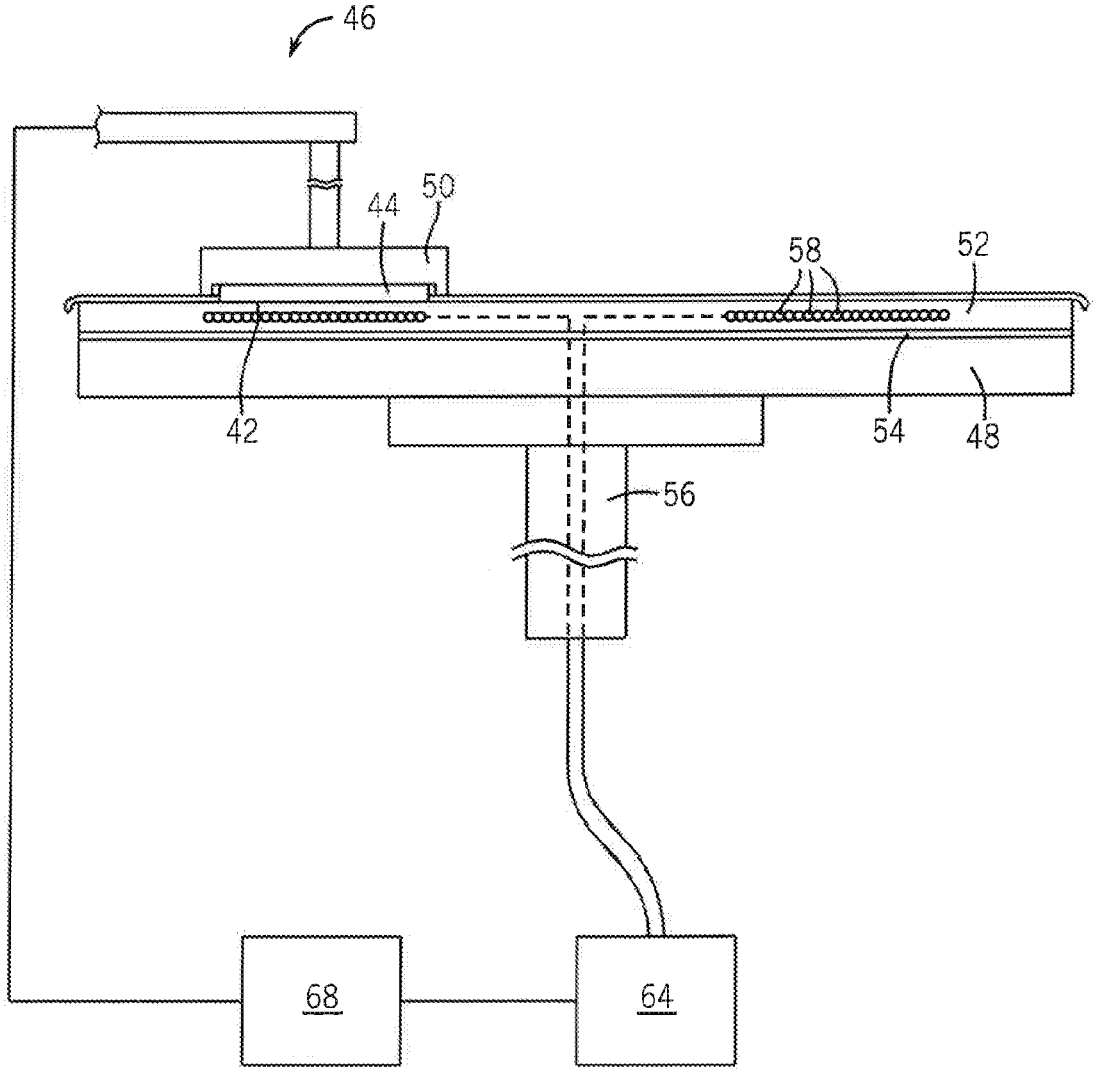
FIG. 5 is a schematic, cross-sectional, elevational view of the apparatus shown in FIGS. 2-3 taken along line 5-5, showing the planarizing pad of FIG. 4A with the sensor incorporated within the pad.

As depicted in FIG. 4A, in one embodiment of a planarizing device 70 according to the invention, the fiber optic impact sensor 58 is incorporated into the body 72 of the planarizing pad 52. For example, the planarizing pad 52 can be fabricated by filling a portion of a mold with a flowable pad material and allowing the material to at least partially solidify or harden to a semi-solid or plastic state, coiling the sensor cable 58 into a configuration according to the wafer track 60 (e.g., circular), placing the coiled sensor cable 58 onto the surface of the semi-hardened pad material, and then filling the remainder of the mold with the pad material. Upon curing or hardening of the pad material, the sensor cable 58 is then embedded within the body 72 of the planarizing pad. A conventional backing film can then releasably attached to the exposed surface of the planarizing pad 52, which can then be removed from the mold. The planarizing pad 52 (with the backing film removed) can then be combined with a subpad 54 on the polishing table or platen 48. FIG. 5 illustrates the planarizing device 70 incorporated into a system 40, in which the sensor cable 58 is connected to a control box 64 connected to a processor 68, which is, in turn, connected to the planarizing apparatus 46.

Figure 4B:
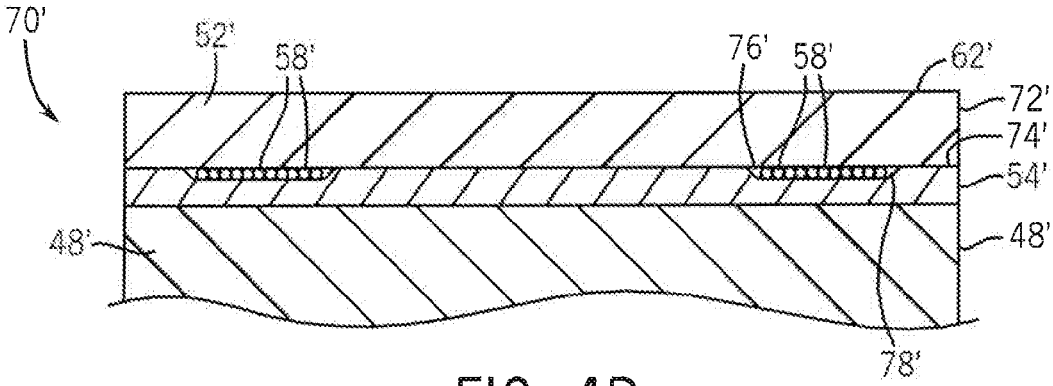

In another embodiment of a planarizing device 70' shown in FIG. 4B, the sensor cable 58' can be positioned between the planarizing (top) pad 52' and a subpad 54' composed of a compressible material such as a polyurethane foam or felt, or a harder and less compressible material. The planarizing device 70' can be fabricated, for example, by adhesively attaching a formed planarizing pad 52' and subpad 54' together, with the sensor 58' positioned therebetween, for example, with a pressure-sensitive adhesive (PSA) material 74' applied to the surface 76' of the planarizing pad 52' and/or the surface 78' of the subpad 54'. The planarizing device 70' can also be fabricated by positioning the coiled sensor 58' onto the exposed surface 76' of the planarizing pad in a semi-solid or plastic state within a mold, allowing the pad material to harden, and attaching the subpad 54' onto the sensor 58' and surface 76' of the planarizing pad 51', for example, using an adhesive 74'.

Figure 4C:
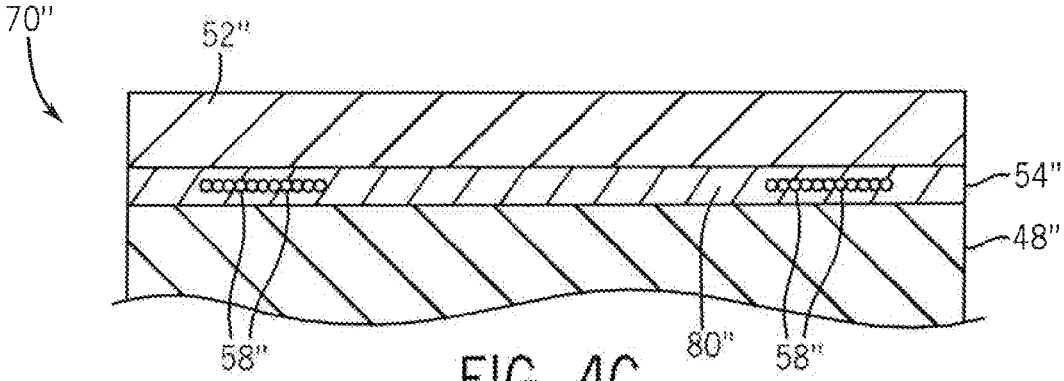

Another embodiment of a planarizing device 70" is illustrated in FIG. 4C, with the sensor 58" incorporated into the body 80" of the subpad 54". For example, to form the planarizing device 70", a mold can be partially filled with the subpad material, which is allowed to at least partially harden (e.g., cure), the sensor cable 58" can be coiled into a desired configuration and positioned onto the surface of the subpad material, and the remainder of the mold can be filled with subpad material, which upon solidifying will contain the sensor 58" within the body of the subpad 54".

Figure 6:
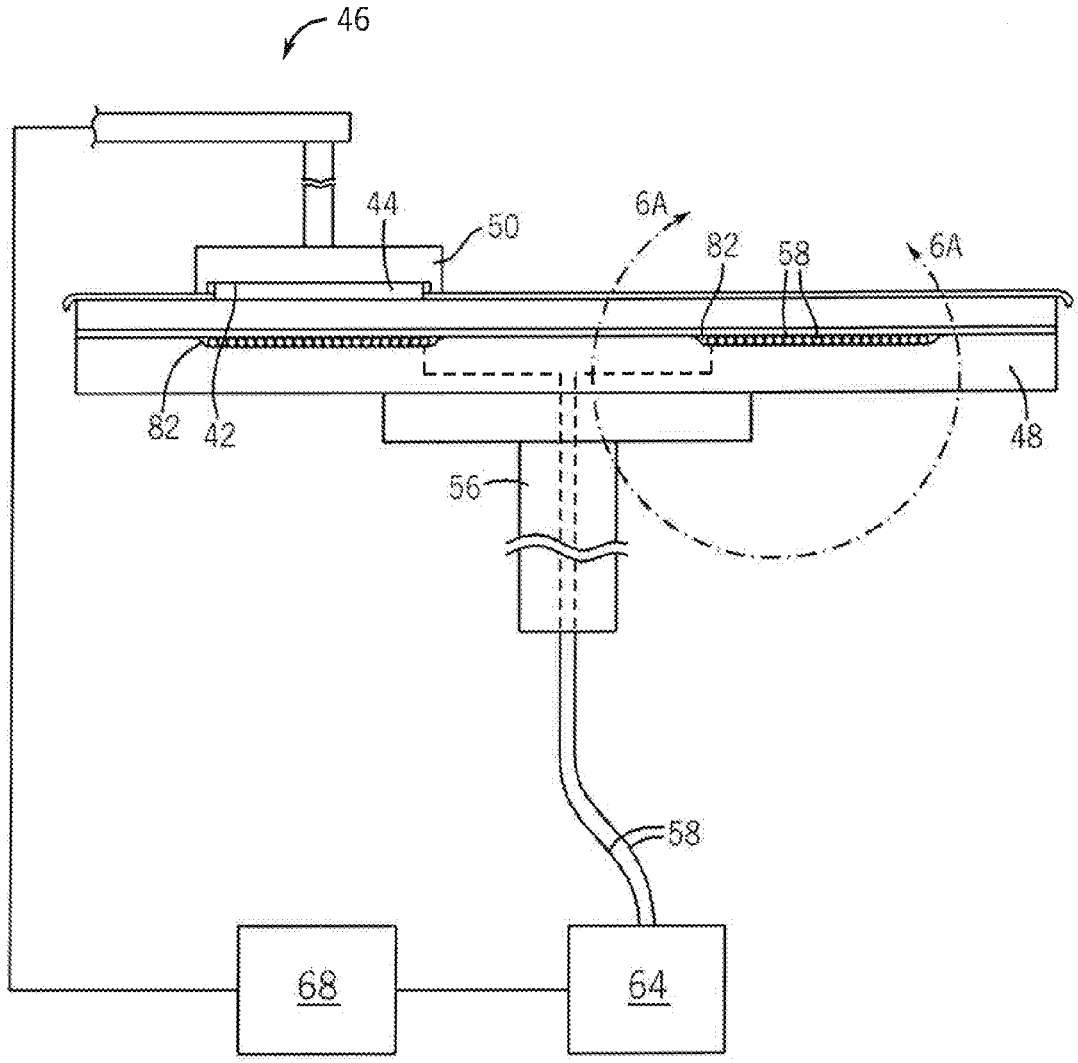
FIGS. 6-6A are schematic, cross-sectional, elevational views of embodiment of a planarizing apparatus according to the invention, showing the sensor incorporated into a support table for a planarizing pad.
Figure 6A:
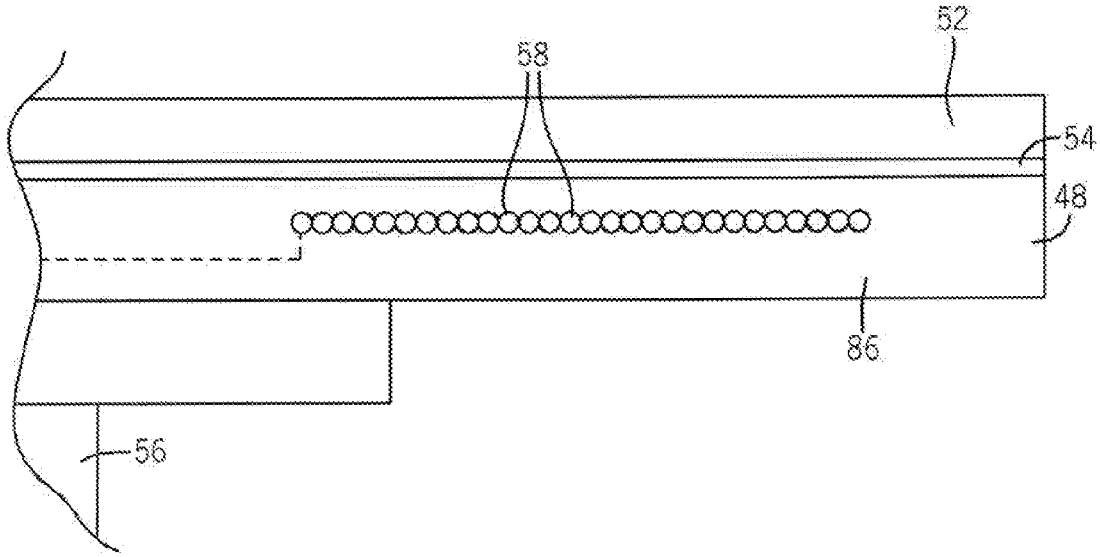

As illustrated in FIGS. 6-6A, the fiber optic impact sensor 58''' can also be incorporated into the polish table 48''' of planarizing apparatus 46'''. In one embodiment shown in FIG. 6, an opening or channel 82''' can be provided in the surface 84''' of the polishing table 48''', for example, by routing or other machining process. Such a channel 82''' is sized for receiving the fiber optic impact sensor 58''' therein, and preferably defines the wafer track 60''' over the planarizing pad 52'''. In another embodiment illustrated in partial view in FIG. 6A, the fiber optic impact sensor 58'''' can also be incorporated directly into the table material itself during its fabrication, for example, by a molding or casting process such that the sensor 58'''' is embedded within the body 86'''' of the table 48''''. Similar to forming the planarizing pad 52 as described above with reference to FIG. 4A, a mold for the polish table 48'''' can be partially filled with the table material in a flowable form which is allowed to at least partially harden, the sensor cable 58'''' can be placed onto the surface of the hardened table material within the mold, and additional table material can be added over the sensor cable 58'''' to fill the mold and then hardened to form the polish table 48'''' with the sensor cable 58'''' incorporated therein.

In the use of a planarizing pad or polish table incorporating a fiber optic impact sensor, during a planarization operation, the wafer surface is in contact with the surface of the planarizing pad, and features on the wafer surface are pressed down into the surface of the pad creating localized pressure points on the pad surface that are passed onto the sensor. This results in changes in intensity of the light wavelength passing through the sensor coil. The localized pressure points will change according to changes to the topography of the wafer surface as the planarization process progresses. With the positioning of the sensor cable within the planarizing pad, subpad, or the polishing table, consideration is given with regard to the loss or attenuation and adequacy of the signal when traveling through multiple layers to the planarizing pad and wafer surface, i.e., signal strength to noise value.

A planarizing process produces a frictional response between the wafer and planarizing pad. As a planarizing operation progresses, the surface topography on the wafer is abraded away and the surface eventually becomes planar, with a resultant change in the frictional characteristics between the planarizing pad and wafer, and associated mechanical vibrations and acoustic emissions that can be monitored over time.

The sensor can be operational as a multifunctional sensor and configured to respond to vibrational and/or acoustic energy emanating from the contact of the planarizing pad and the surface of the wafer or other substrate during CMP processing. Preferred specifications for the fiber optic sensor include a wavelength of about 200-800 nm; (white-light spectrum), wavelength intensity changes of about 0.01-100%, a temperature range of environment of about minus 100° C. to +300° C., and a frequency range of DC to 100 MHz.

During a CMP processing, a variable mechanical energy response in the form of vibration is produced at those points where the surface of the wafer is in contact with a planarizing pad. The vibration that is emanated from the wafer surface is a function of the process parameters, including, for example, the amount of pressure applied to the surface of the planarizing pad, the relative velocities between the wafer carrier and the polish table, the chemical slurry and planarizing pad, and the materials and topography on the surface of the wafer. In the case of mechanical energy and vibrational energy, the vibrations produce localized dynamic pressure variation across the fiber optic contact sensor, which, in turn, produces corresponding intensity fluctuations that can be read and monitored.

In addition to monitoring mechanical vibrations that occur during CMP processing, the system of the invention can also operate to monitor acoustic emissions (AE) in the form of ultrasonic vibrations produced from the interaction of the wafer, the planarizing solution or slurry chemistry, and planarizing pad. The strength of acoustic emission signals is high at the beginning of a planarizing process and decreases as planarization progresses. Acoustic emissions generated from contact of the planarizing pad and the wafer surface impact the optical fiber sensor, resulting in a change in refractive index of the optical fiber. That change produces an optical effect on the optical radiation passing through the fiber, which can be detected and is proportional to the incident acoustic wave.

Changes in the signal represent changes in the properties of the wafer surface such as transitions of layer thickness, composition, or topography. For example, the amount of vibrational or acoustic energy emitted from the wafer-pad interface may vary with the changes in the frictional contact with different material layers, for example, copper in a trench, a dielectric layer, etc.

The signals generated with the vibrational or acoustic emissions can be monitored and collected during a planarizing process, and analyzed according to known methods to relate the signal to a change in surface topography or other characteristic, or to an end-point for a planarizing operation, and provide real-time information on a processing operation. For example, vibrational energy emanating from a non-uniform wafer surface can be detected and attributed to polishing a radii on the wafer at a faster rate than another radii.

A set response such as altering the speed or other parameter of the planarizing operation, or terminating the planarizing process can be triggered by the interruption or perturbation of the fiber sensor resulting in a change in the vibrational or acoustic emission energy signal, or the signal reaching a predetermined or set level that is programmed into the processor.

Data can be collected from a series of test wafers and correlated to particular surface properties. A model or standard for the analysis can be established, for example, by sampling vibration or acoustic emission signals of a chemical mechanical process, and associating the emission signals with a processing event or characteristic for that process. For example, to establish a standard for analysis of sampled acoustic emission signals, a control sample can be analyzed using a scanning electron microscope or other device, and the acoustic emission signals obtained from the control sample can be used to establish a standard for the analysis of the acoustic emissions of the subject wafer. See, for example, D. E. Lee, et al., "In-Situ Acoustic Emission Monitoring of Surface Chemical Reactions for Copper CMP," *Laboratory for Manufacturing Automation. Precision Manufacturing Group*. Paper lee_05_1; http://repositories.cdlib.org/lma/pmg/lee_05_1 (Jul. 1, 2005).

For example, a sequence of timed polishings can be conducted on a plurality of wafers having about identical characteristics, and the change over time in sensor measurements of the vibrational or acoustic energy and signal at a time zero ($T_0$) and subsequent time segments (e.g., $T_1$, $T_2$, etc.) can be correlated to the surface state (e.g., topography, layer composition, etc.) and/or the degree of completion (e.g., 10%, 25%, 80%, etc.) to completion of the planarizing operation. This process is useful for identifying a standard planarizing process that applies generally to a series of wafers.

Such reference data can be used as reference points for a particular processing operation such that as the planarizing operation progresses through different material levels or layers, a characteristic vibration or acoustic response would be emitted according to the structure and/or material being removed. Variables associated with a particular structural level on a wafer could be input into the system.

In developing a model, transition points where it may be desirable to temporally stop the operation at the transition from one process step to a second process step, can be identified based on the change and evolution of the surface topography during processing as identified through the change in signal.

An exemplary application of the invention is in a polishing operation to form copper wiring in a trench or contact opening. A single polishing process to remove the copper can result in dishing and erosion of the wiring in the opening. In such an application, it is desirable to use one set of process parameters in a first polishing step and a second set of parameters in a further polishing step. To achieve that, characteristics of the wafer surface can be monitored with the sensor during the first polishing step, and the process stopped at an intermediate point based on the vibrational or acoustic signature (signal) that is generated. The planarizing process could than be transitioned from a high rate process that utilizes a high down force to a lower rate process to preserve and minimize erosion and dishing of the copper in the opening.

In another embodiment, the system can also be employed in a planarizing apparatus for conditioning a planarizing pad. With a newly manufactured planarizing pad, the contact surface is not optimal and requires distressing to remove an amount of material from the surface such that it is uniformly rough across the entire surface. Typically, the planarizing pad is conditioned for a fixed time, which can over-condition the pad. The conditioning of a planarizing pad can be monitored according to change of the vibration and acoustic energy emanating from the frictional contact of the conditioning pad with the planarizing pad, and the change in signal from the fiber optic sensor within or associated with the pad, subpad, and/or polish table. A uniform vibration or acoustic state would indicate the achievement of a desired or uniform roughness across the surface of the planarizing pad. The conditioning process could then be terminated at an optimal point in the process.

Figure 7:
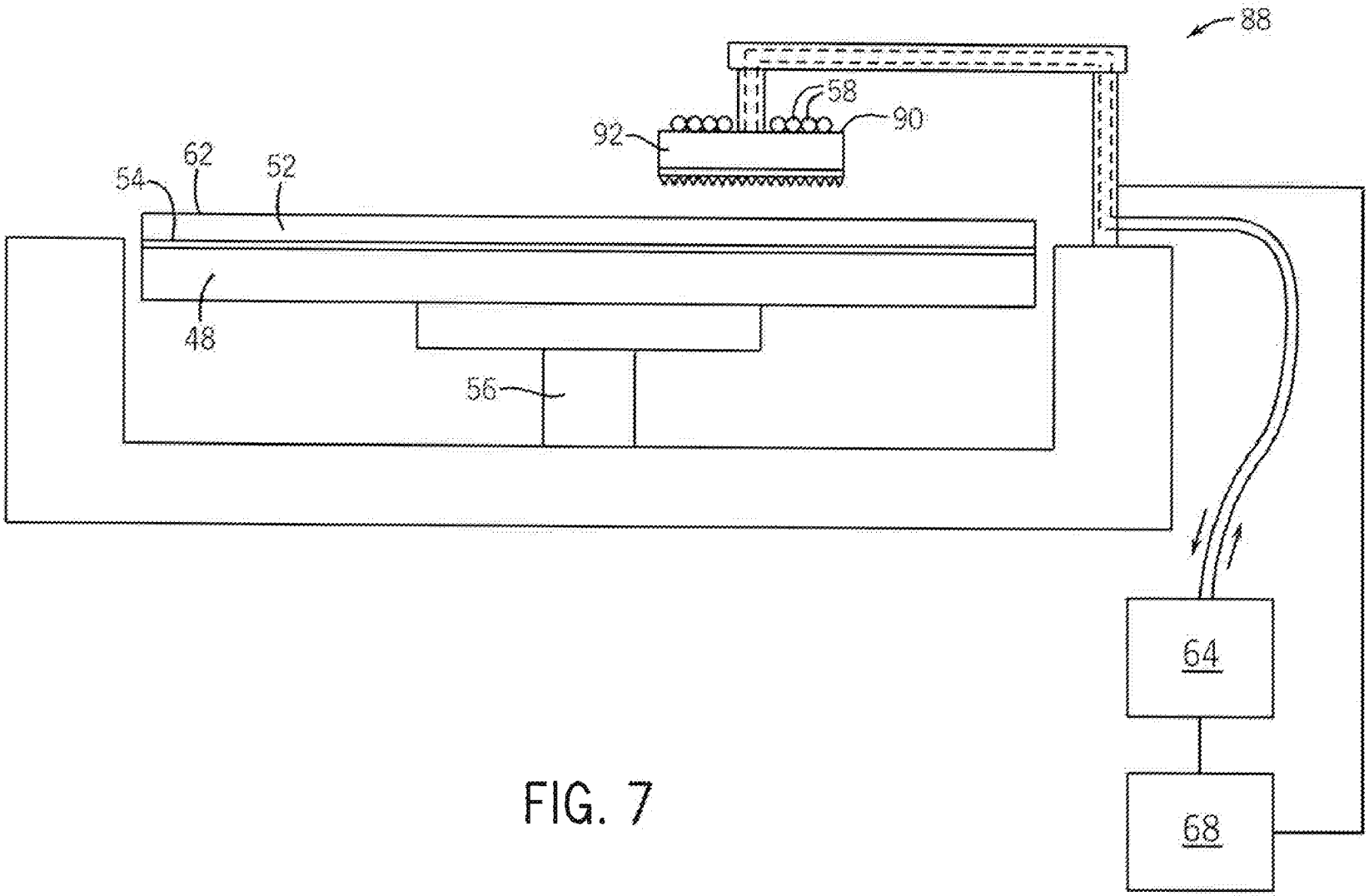
FIG. 7 is a schematic, cross-sectional, elevational view of an embodiment of a system for monitoring the conditioning of a processing pad according to the invention.

Referring to FIG. 7, another aspect of the invention provides a conditioning pad assembly 88 that incorporates a fiber optic contact sensor 58 mounted on the back surface 90 of the conditioning pad holder 92. The surface 62 of a planarizing pad 52 can then be monitored during a conditioning operation based upon changes in the vibration and/or acoustic energy emissions to the fiber optic sensor 58 on the conditioning pad holder 92. Signals from the sensor 58 are transmitted to a control box 64 containing optoelectronics and onto a processor 68 to monitor the progress and endpoint the conditioning operation, which can then relay signals to the conditioning apparatus 88 to alter or stop the process. The sensor cable 58 can be mounted on the surface 90 of the conditioning pad holder 92 by the application of an adhesive material.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A CMP planarizing pad, comprising: a fiber optic impact sensor for monitoring a surface of a substrate, the impact sensor embedded within the planarizing pad and operable to transmit light signals therethrough which light signals are varied solely in response to vibrational energy, acoustic energy, or a combination thereof conveyed to the impact sensor, the energy occurring from contact of the pad with the substrate surface during CMP and detected by the sensor to monitor the surface of the substrate.

2. The pad of claim 1, wherein the sensor comprises a cable arranged within the pad to define a wafer track.

3. The pad of claim 2, wherein the sensor cable is continuous about the wafer track.

4. The pad of claim 2, wherein the sensor cable is situated in one or more distinct sections of the wafer track.

5. A CMP planarizing pad, comprising: a subpad attached thereto, and a fiber optic impact sensor for monitoring a surface of a substrate, the impact sensor situated between the planarizing pad and the subpad, the impact sensor operable to transmit light signals therethrough, which light signals are varied solely in response to vibrational energy, acoustic energy, or a combination thereof conveyed to the impact sensor, the energy occurring from contact of the pad with the substrate surface during CMP and detected by the sensor to monitor the surface of the substrate.

6. A subpad for a CMP planarizing pad, comprising: a fiber optic impact sensor cable for monitoring a surface of a substrate, the impact sensor cable situated within the subpad, the impact sensor operable to transmit light signals therethrough, which light signals are varied solely in response to vibrational energy, acoustic energy, or a combination thereof conveyed to the impact sensor, the energy occurring from contact of the CMP pad with the substrate surface during CMP and detected by the sensor to monitor the surface of the substrate.

7. The subpad of claim 6, wherein the sensor cable is arranged within the subpad to define a wafer track.

8. The subpad of claim 6, comprising a compressible material.

9. The subpad of claim 8, wherein the compressible material is selected from the group consisting of polyurethane foam and felt.

10. A CMP planarizing pad, comprising: a subpad attached thereto and a fiber optic impact sensor situated within the subpad, the impact sensor for monitoring a surface of a substrate and operable to transmit light signals therethrough, which light signals are varied solely in response to vibrational energy, acoustic energy, or a combination thereof conveyed to the impact sensor, the energy occurring from contact of the CMP pad with the substrate surface during CMP and detected by the sensor to monitor the surface of the substrate.

11. A CMP planarizing pad, comprising: a fiber optic impact sensor for monitoring a surface of a substrate, the impact sensor configured to transmit signals therethrough, which light signals are varied solely in response to vibrational energy, acoustic energy, or a combination thereof conveyed to the impact sensor, the energy occurring from contact of the CMP pad with the substrate surface during CMP and detected by the sensor to monitor the surface of the substrate.

12. The pad of claim 11, wherein the sensor comprises a cable situated to define an oval or circular array on the pad.

13. The pad of claim 12, wherein the cable is continuous about said oval or circular array.

14. The pad of claim 12, wherein the cable is situated in discrete sections about said oval or circular array.

15. The pad of claim 11, wherein the sensor is situated within the pad.

16. The pad of claim 11, further comprising a subpad attached thereto.

17. The pad of claim 16, wherein the sensor is situated between the pad and the subpad.

18. The pad of claim 16, wherein the sensor is situated within the subpad.

19. The pad of claim 11, comprising abrasive particles.

20. The pad of claim 11, situated on a support.

21. The pad of claim 11, wherein the sensor is configured to convey a light source to a receiver.

22. The pad of claim 21, wherein intensity of the light source is varied by impact of vibrations from frictional contact of the planarizing pad with a substrate.

23. The pad of claim 21, wherein intensity of the light source is varied by impact of acoustic emissions from frictional contact of the planarizing pad with a substrate.

* * * * *